US010315807B2

(12) United States Patent
Septien-Rojas et al.

(10) Patent No.: US 10,315,807 B2
(45) Date of Patent: Jun. 11, 2019

(54) AIR POCKET FLANGE CLOSURE FOR PUSH-TO-OPEN RECLOSEABLE PACKAGES

(71) Applicants: Jose Manuel Septien-Rojas, Glenview, IL (US); Murray Leighton, Glenview, IL (US); Martin Offa-Jones, Glenview, IL (US)

(72) Inventors: Jose Manuel Septien-Rojas, Glenview, IL (US); Murray Leighton, Glenview, IL (US); Martin Offa-Jones, Glenview, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 205 days.

(21) Appl. No.: 15/505,948

(22) PCT Filed: Oct. 29, 2015

(86) PCT No.: PCT/US2015/058030

§ 371 (c)(1),
(2) Date: Feb. 23, 2017

(87) PCT Pub. No.: WO2016/069883

PCT Pub. Date: May 6, 2016

(65) Prior Publication Data

US 2018/0222637 A1 Aug. 9, 2018

Related U.S. Application Data

(60) Provisional application No. 62/069,918, filed on Oct. 29, 2014, provisional application No. 62/102,696, filed on Jan. 13, 2015.

(51) Int. Cl.
*B65D 33/25* (2006.01)

(52) U.S. Cl.
CPC ..... *B65D 33/2508* (2013.01); *Y10T 24/2534* (2015.01)

(58) Field of Classification Search
CPC ..... B65D 33/25; B65D 33/2591; B65D 33/2508; Y10T 24/15; Y10T 24/25; Y10T 24/2532; Y10T 24/2534
See application file for complete search history.

(56) References Cited

U.S. PATENT DOCUMENTS

2006/0168774 A1* 8/2006 Pawloski ..... B65D 33/2508 24/399
2006/0168775 A1* 8/2006 Turvey ..... B65D 33/2508 24/399

(Continued)

OTHER PUBLICATIONS

International Search Report issue in PCT/US2015/058030 dated Jan. 15, 2016.

*Primary Examiner* — Robert Sandy
*Assistant Examiner* — Michael S Lee
(74) *Attorney, Agent, or Firm* — McCarter & English, LLP

(57) ABSTRACT

The present disclosure relates to a closure for a reclosable package wherein the product side flanges include opposing air pockets thereby allowing a user to more easily grab the product side flanges or the package walls. In a second embodiment of the disclosure, the opposing air pockets are adjacent to the interlocking elements of the closure. In a further aspect of the disclosure, a closure includes a small sack or air or other fluid adjacent to the closure profiles. When closed, the closure creates a leak resistant configuration. By pressing the air sack, the user separates the closure profiles.

21 Claims, 3 Drawing Sheets

(56) References Cited

U.S. PATENT DOCUMENTS

| | | | | |
|---|---|---|---|---|
| 2009/0190863 | A1* | 7/2009 | Calvo | B65D 33/01 383/64 |
| 2010/0014787 | A1* | 1/2010 | Katada | B65D 33/2508 383/63 |
| 2010/0150477 | A1* | 6/2010 | Bois | B65D 33/2541 383/42 |
| 2011/0041466 | A1 | 2/2011 | Tilman et al. | |
| 2011/0200275 | A1 | 8/2011 | Perell et al. | |
| 2012/0036684 | A1 | 2/2012 | Tilman et al. | |
| 2012/0076440 | A1* | 3/2012 | Gallagher | B65D 33/20 383/4 |
| 2014/0102436 | A1* | 4/2014 | Jo | B65D 81/34 126/263.08 |
| 2018/0148228 | A1* | 5/2018 | Bray | B65D 33/2508 |

* cited by examiner

AIR POCKET FLANGE CLOSURE FOR PUSH-TO-OPEN RECLOSEABLE PACKAGES

BACKGROUND OF THE DISCLOSURE

This application is a National Phase Application of PCT International Application No.: PCT/US2015/058030 filed on Oct. 29, 2015, which claims priority under 35 U.S.C. 119(e) of U.S. provisional application Ser. No. 62/069,918, filed on Oct. 29, 2014, and U.S. provisional application Ser. No. 62/102,696, filed on Jan. 13, 2015, the contents of which is hereby incorporated by reference in its entirety and for all purposes.

BACKGROUND OF THE DISCLOSURE

Field of the Disclosure

The present disclosure relates to a closure for a reclosable package wherein air pockets are formed on the flanges of the closure. A further aspect of the present disclosure relates to a closure which contains a small sack of air adjacent to and impinging upon the closure profiles. When closed, the closure creates a leak-resistant configuration. By pressing the air sack, the user separates the closure profiles.

Description of the Prior Art

Closures for reclosable packages are well-known in the prior art and well-developed for their intended purposes. However, sometimes it may be difficult for the consumer, particularly if aged or otherwise challenged, to grab the flanges or package walls in order to separate the flanges or package walls thereby opening the package.

Moreover, in the marketplace, there may be a movement away from rigid packaging to flexible packaging, with an interest in "liquid pouches". While spouts are frequently provided for such packages, the traditional way of opening a zipper or closure can be inconvenient in that this requires two hands instead of one.

OBJECTS AND SUMMARY OF THE DISCLOSURE

It is therefore an object of the present disclosure to provide a zipper, closure or reclosure for a reclosable package which allows a consumer to more easily grab the flanges or package walls in order to open the package.

It is therefore a further object of the present disclosure to provide improvements in the art of closures, reclosures and zippers for containers, particularly with respect to push-to-open closures.

These and other objects are attained by providing a closure, reclosure or zipper for a reclosable package, wherein the consumer side flanges include opposing compartments filled with air. This provides sufficient separation between the consumer side flanges or between the package walls to allow the consumer to grab the consumer side flanges or package walls more easily. Moreover, if the compartments are provided adjacent to the interlocking elements of the closure, it is possible for the user to squeeze the air-filled compartments thereby forcing apart the interlocking elements of closure.

In a further aspect of the present disclosure, a closure is provided which contains a small sack of air adjacent to the closure profiles. When closed, the closure creates a leak-resistant configuration. By pressing the air sack, the user separates the closure profiles. This typically allows the closure to be opened with one hand. Moreover, the elimination of the spout may result in reduced weight, reduced waste, reduced volume of the empty pouch, and reduced costs, particularly in view of possible faster integration speeds.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
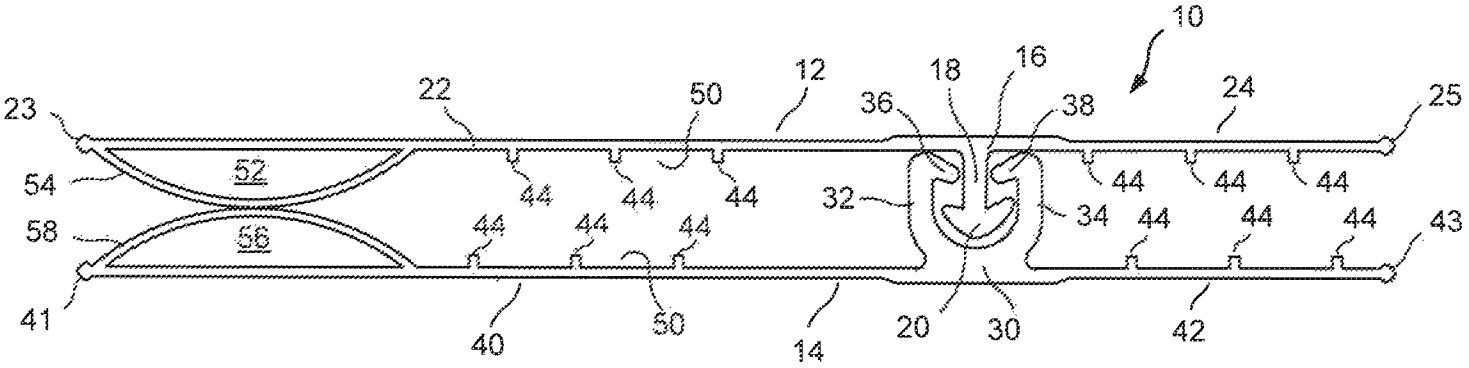
FIG. 1 is a cross-sectional view along plane 1-5-1-5 of FIG. 6, illustrating a first embodiment of the closure of the present disclosure.

Referring now to the drawings in detail, wherein like numerals indicate like elements through the several views, one sees that FIG. 1 is a cross-sectional view of a first embodiment of the closure, reclosure or zipper 10, which is typically formed from polymeric material. The closure 10, which is typically used in a reclosable package or bag 1000 (see FIG. 6) includes a first closure profile 12 and a second closure profile 14. The first closure profile 12 includes a first interlocking element 16 which is in the form of a male element with a shaft 18 and an arrowhead-shaped head 20. In the illustrated orientation, a first consumer side flange 22 extends to the left of the first interlocking element 16 terminating in first consumer side tip 23 and a first product side flange 24 extends to the right of the first interlocking element 16 terminating in first product side tip 25. As used in this disclosure, the term "consumer side" refers to the side of the closure which is directed toward the consumer or the exterior of the mouth of the reclosable package, while the term "product side" refers to the side of the closure which is directed to the storage volume of the package, wherein the contents or product is stored.

The second closure profile 14 includes a second interlocking element 30 which is in the form of a female element with first and second extending arms 32, 34 terminating in respective first and second detent hooks 36, 38 for engaging edges of the arrowhead-shaped head 20, as illustrated. In the illustrated orientation, a second consumer side flange 40 extends to the left of the second interlocking element 30 terminating in second consumer side tip 41 and a second product side flange 42 extends to the right of the second interlocking element 30 terminating in second product side tip 43. The interior faces of flanges 22, 24, 40, 42 include inwardly facing spacers 44 to reduce the sealing between the flanges of first and second closure profiles 12, 14 when the exterior faces of first and second closure profiles 12, 14 are sealed or otherwise joined to the interior walls of a reclosable package (not shown, typically formed from polymeric material). However, a peelable seal area 50 is typically formed between the first and second consumer side flanges 22, 40. Additionally, in some embodiments, the first and second consumer side flanges 22, 40 may extend a short distance beyond their tips 23, 41.

First air pocket 52 is formed between first interior pocket wall 54 and first consumer side flange 22, as generally bounded by first consumer side tip 23 and peelable seal area 50. Likewise, second air pocket 56 is formed to oppose and abut first air pocket 52, between second interior pocket wall 58 and second consumer side flange 40, as generally bounded by second consumer side tip 41 and peelable seal area 50. First and second air pockets 52, 56 typically will be formed by insertion of compressed air in the die during the formation of the flanges 22, 24, 40, 42 of the closure 10. First and second air pockets 52, 56 (and the first and second interior pocket walls 54, 58) abut and oppose each other so as to separate first and second consumer side tips 23, 41, thereby allowing a consumer to more easily grasp the first and second consumer side tips 23, 41, or the package walls (not shown) attached thereto, and to separate them, thereby peeling open the peelable seal area 50 and separating the first and second interlocking elements 16, 30 from each other, thereby gaining access to the storage volume of the package.

Figure 2:
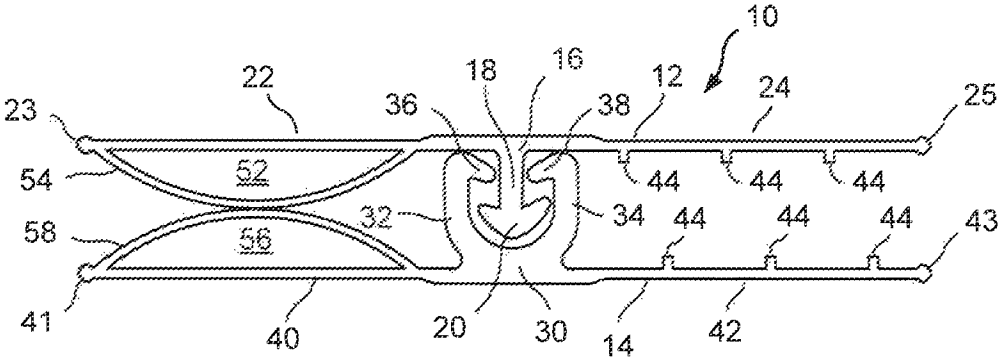
FIG. 2 is a cross-sectional view along plane 1-5-1-5 of FIG. 6, illustrating a second embodiment of the closure of the present disclosure.

FIG. 2 is a cross-sectional view of a second embodiment of the closure 10, wherein the elements are similar to those of FIG. 1. However, first and second air pockets 52, 56 are adjacent to first and second interlocking elements 16, 30 in the absence of a peel seal so that the user pressing on the first and second air pockets 52, 56 can cause the separation of the first and second interlocking elements 16, 30. Alternatively, a peelable seal area similar to that illustrated as element 50 in FIG. 1 may be placed on the first and second product side flanges 24, 42. A further alternative is a very thin peelable seal area placed between the first and second air pockets 52, 56 and the first and second interlocking elements 16, 30. In the embodiment of FIG. 2, the user can press down upon the opposing first and second air pockets 52, 56 in order to separate the first and second interlocking elements 16, 30. That is, by placing the first and second air pockets 52, 56 next to the interlocking members 16, 30, it could be possible to compress the consumer half of the air pockets, which would cause the portion of the air pocket next to the interlocking elements 16, 30 to expand, thereby forcing the interlocking members 16, 30 to separate.

Figure 3:
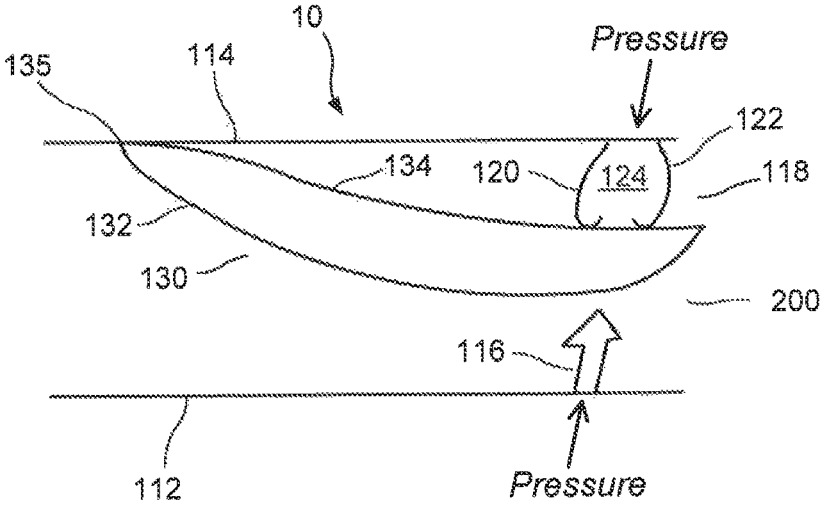
FIG. 3 is a cross-sectional view along plane 1-5-1-5 of FIG. 6, illustrating an embodiment of a further aspect of the closure, illustrating how the closure is closed.
Figure 4:
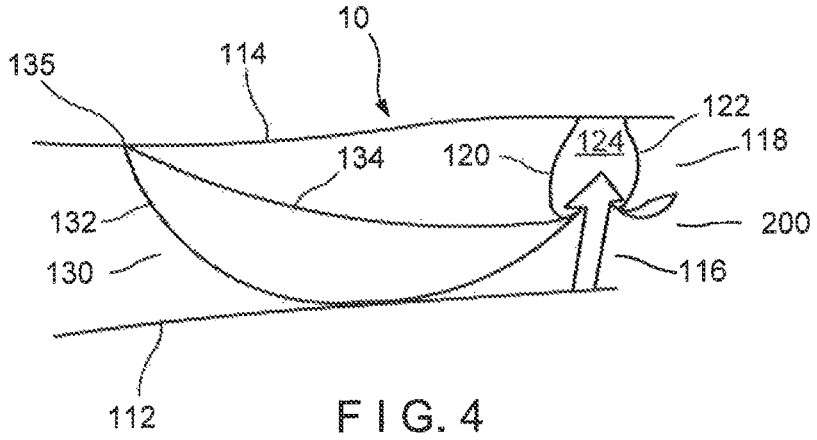
FIG. 4 is a cross-sectional view along plane 1-5-1-5 of FIG. 6, illustrating an embodiment of a further aspect of the closure, illustrating the closure in a closed position in a leak-resistant configuration.
Figure 5:
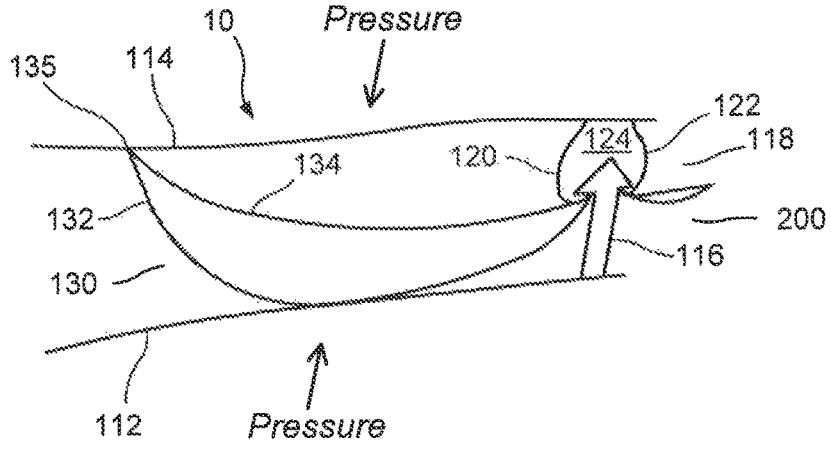
FIG. 5 is a cross-sectional view along plane 1-5-1-5 of FIG. 6, illustrating an embodiment of a further aspect of the closure illustrating how the closure is opened.
Figure 6:
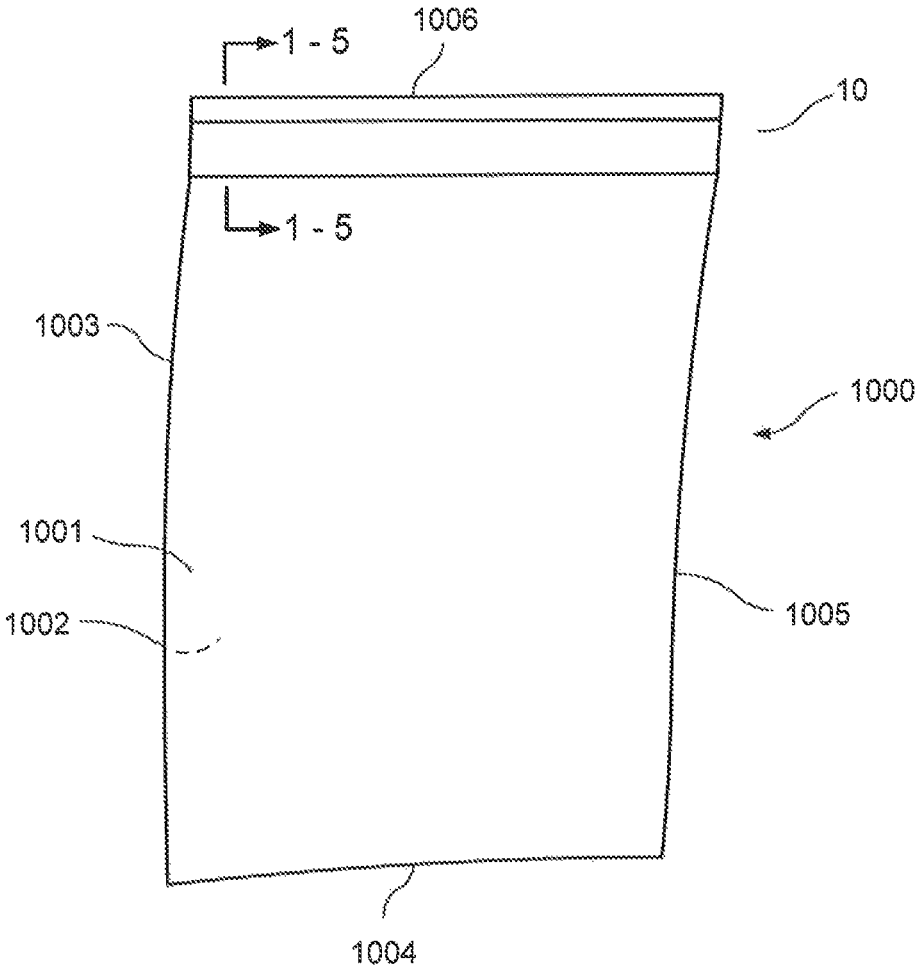
FIG. 6 is a plan view of a typical reclosable package using the closure of the present disclosure.

A further aspect of the disclosure is illustrated in FIGS. 3-5. The closure, reclosure or zipper 10, which is typically made from polymeric material, includes a first flange 112 and a second flange 114, between which a closable mouth 200 is formed. First and second flanges 112, 114 are intended to be connected to opposing walls 1001, 1002 of a container, bag, pouch 1000 or similar product as shown in FIG. 6. The first flange 112 includes a male closure element 116 while the second flange 114 includes a female closure element 118 with two extending arms 120, 122 with a space 124 therebetween for receiving the male closure element 116 in a closed leak-resistant configuration as shown in FIG. 4. Additionally, a sack of air (or other fluid, fluid being defined as a gas or a fluid, such as, but not limited to, air or water, respectively) 130 is formed by walls 132, 134 and is secured at one end by a connection point 135 to the second flange 114 so that a portion of the sack 130 extends over the female closure element 118. A portion of sack 130 is engaged between the male and female closure elements 116, 118 in the closed position as shown in FIG. 4. Between male and female closure elements 116, 118, the walls 132, 134 of sack 130 are pressed against each other, or at least in very close proximity to each other. In some embodiments, wall 134 may be sealed to at least one of extending arms 120, 122 in order to maintain sack 130 in the proper position. In order to separate the male and female closure elements 116, 118 from each other thereby opening the closure 10, the user presses against the sack of air 130, close to the connection point 135, as shown in FIG. 3, thereby forcing air into the portion of the sack 130 engaged between the male and female closure elements 116, 118. This forces the walls 132, 124 apart from each other in the portion which is engaged between male and female closure elements 116, 118. This separates the male and female closure elements 116, 118 thereby opening the closure 10 and providing access to the associated bag or container (see package 1000 of FIG. 6) through mouth 200. While male and female closure elements are disclosed, a wide range of closure elements, as well as flange configurations, are adaptable to this disclosure.

FIG. 6 illustrates a typical, but not restrictive, application of the closure, reclosure of zipper 10 of the present disclosure. A package 1000 is provided which is formed from two coextensive walls 1001, 1002, typically of polymeric or similar material, sealed together by side seals 1003, 1005 and bottom seal 1004, thereby leaving an upper reclosable mouth 1006 which is made reclosable by the closure, reclosure or zipper 10 being sealed to the interior of walls 1001, 1002 along a width thereof.

Thus the several aforementioned objects and advantages are most effectively attained. Although preferred embodiments of the invention have been disclosed and described in detail herein, it should be understood that this invention is in no sense limited thereby.

What is claimed is:

1. A closure for a reclosable package, including:

a first closure profile including a first interlocking element;

a second closure profile including a second interlocking element;

first and second consumer side flanges extending from the respective first and second profiles;

the first consumer flange including a first air pocket wall extending from an inward surface of the first consumer flange thereby forming a first air pocket;

the second consumer flange including a second air pocket wall extending from an inward surface of the second consumer flange thereby forming a second air pocket;

a peelable seal area on the first consumer side flange between a tip of the consumer side flange and the first interlocking element and between a tip of the second consumer side flange and the second interlocking element; and wherein the first and second air pocket walls face each other thereby separating the tips of the first and second consumer side flanges.

2. The closure of claim 1 wherein the first and second closure profiles further include respective first and second product side flanges.

3. The closure of claim 2 wherein the first and second consumer side flanges are on a first side of the respective first and second interlocking elements and the first and second product side flanges are on a second side of the respective first and second interlocking elements.

4. The closure of claim 3 wherein the first interlocking element is a male element and the second interlocking element is a female element.

5. The closure of claim 4 wherein the male element is an arrowhead shape and the female element includes first and second outwardly extending arms terminating in respective first and second detent hooks.

6. A closure of claim 1, wherein the closure is made from polymeric material.

7. A closure for a reclosable package, including:

a first closure profile including a first interlocking element;

a second closure profile including a second interlocking element;

first and second consumer side flanges extending from the respective first and second profiles;

the first consumer flange including a first air pocket wall extending from an inward surface of the first consumer flange thereby forming a first air pocket;

the second consumer flange including a second air pocket wall extending from an inward surface of the second consumer flange thereby forming a second air pocket;

wherein the first and second air pockets are adjacent to the respective first and second interlocking elements whereby manual pressure on the first and second air pockets separates the first and second interlocking elements from each other.

8. The closure of claim 7 wherein the first and second closure profiles further include respective first and second product side flanges.

9. The closure of claim 8 wherein the first and second consumer side flanges are on a first side of the respective first and second interlocking elements and the first and second product side flanges are on a second side of the respective first and second interlocking elements.

10. The closure of claim 9 wherein the first interlocking element is a male element and the second interlocking element is a female element.

11. The closure of claim 10 wherein the male element is an arrowhead shape and the female element includes first and second outwardly extending arms terminating in respective first and second detent hooks.

12. A closure for a reclosable package, including;

a first closure profile with a first interlocking element;

a second closure profile with a second interlocking element; and the second closure profile including a fluid pocket which extends over the second interlocking element, wherein, in an interlocked configuration between the first and second interlocking elements, the fluid pocket is engaged between the first and second interlocking elements.

13. The closure of claim 12 wherein manual pressure on the fluid pocket releases an interlocked configuration between the first and second interlocking configuration.

14. The closure of claim 13 wherein the first closure profile includes a first flange and the second closure profile includes a second flange.

15. The closure of claim 14 wherein the fluid pocket contains gas.

16. The closure of claim 15 wherein the fluid pocket contains air.

17. The closure of claim 14 wherein the fluid pocket contains liquid.

18. The closure of claim 17 wherein the fluid pocket contains water.

19. The closure of claim 14 wherein the first interlocking element is a male element and the second interlocking element is a female element.

20. The closure of claim 19 wherein the male element is an arrowhead shape and the female element includes first and second outwardly extending arms terminating in respective first and second detent hooks.

21. The closure of claim 12 wherein the closure is made from polymeric material.

* * * * *